US011214411B2

(12) United States Patent
Ross

(10) Patent No.: US 11,214,411 B2
(45) Date of Patent: Jan. 4, 2022

(54) CHILDPROOF TAMPER EVIDENT CLOSURE ASSEMBLY

(71) Applicant: Ball Corporation, Broomfield, CO (US)

(72) Inventor: John R. Ross, Broomfield, CO (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 16/845,859

(22) Filed: Apr. 10, 2020

(65) Prior Publication Data

US 2020/0324941 A1 Oct. 15, 2020

Related U.S. Application Data

(60) Provisional application No. 62/833,304, filed on Apr. 12, 2019.

(51) Int. Cl.
*B65D 41/34* (2006.01)
*B67B 3/20* (2006.01)

(52) U.S. Cl.
CPC ..... *B65D 41/349* (2013.01); *B67B 3/20* (2013.01)

(58) Field of Classification Search
CPC .... B65D 41/349; B65D 41/348; B65D 41/34; B65D 41/3428; B65D 41/0485; B65D 41/62; B65D 50/041; B65D 50/046; B65D 51/18; B67B 3/20
USPC ..... 215/220, 219, 221, 228, 252, 251, 250; 220/254.8, 254.1, 259.3, 256.1, 212; 222/153.1
See application file for complete search history.

(56) References Cited

U.S. PATENT DOCUMENTS

| | | | | |
|---|---|---|---|---|
| 1,916,859 A | | 7/1933 | Heller | |
| 3,398,848 A | | 8/1968 | Donovan | |
| 3,692,199 A | * | 9/1972 | Mumford | B65D 50/041 215/220 |
| 3,722,727 A | * | 3/1973 | Gach | B65D 50/041 215/220 |

(Continued)

FOREIGN PATENT DOCUMENTS

| | | |
|---|---|---|
| GB | 697583 | 9/1953 |
| GB | 2537370 | 8/2019 |
| WO | WO 2005/077777 | 8/2005 |

OTHER PUBLICATIONS

Official Action for U.S. Appl. No. 16/858,008, dated Mar. 24, 2021 22 pages.

(Continued)

*Primary Examiner* — Robert J Hicks
(74) *Attorney, Agent, or Firm* — Sheridan Ross PC

(57) ABSTRACT

Systems, methods, and apparatuses for sealing bottles with a Roll-on Pilfer Proof (ROPP) closure and a childproof overcap are provided. More specifically, the present disclosure relates to an overcap that can be placed onto or formed onto the ROPP closure. The overcap has a retainer that secures the overcap to the ROPP closure and allows the overcap to move relative to the ROPP closure in a longitudinal axis. The overcap moves between a first position or mode of operation where the overcap can rotate about the ROPP closure and a second position or mode of operation where the overcap engages the ROPP closure to transmit a twisting or torque force to the ROPP closure and open the bottle.

20 Claims, 13 Drawing Sheets

(56) References Cited

U.S. PATENT DOCUMENTS

| | | | | |
|---|---|---|---|---|
| 3,777,924 | A * | 12/1973 | Kayser | B65D 50/041 215/215 |
| 3,809,272 | A | 5/1974 | Maki | |
| 3,812,990 | A | 5/1974 | Willis | |
| 3,934,745 | A | 1/1976 | Lovell | |
| 4,598,833 | A | 7/1986 | Herr | |
| 4,782,965 | A * | 11/1988 | Wassilieff | B65D 50/041 215/220 |
| 4,971,212 | A | 11/1990 | Kusz | |
| 5,611,443 | A | 3/1997 | King | |
| 5,850,951 | A | 12/1998 | Hayes | |
| 7,815,061 | B1 | 10/2010 | Robinson et al. | |
| 8,777,032 | B2 | 7/2014 | Biesecker et al. | |
| 8,820,553 | B2 | 9/2014 | Endert | |
| 10,414,560 | B1 * | 9/2019 | Aryanpanah | B65D 50/04 |
| 2004/0045926 | A1 | 3/2004 | Williamson | |
| 2006/0169665 | A1 | 8/2006 | Matukawa et al. | |
| 2007/0131641 | A1 | 6/2007 | Higgins | |
| 2011/0024423 | A1 | 2/2011 | Erspamer et al. | |
| 2014/0263150 | A1 | 9/2014 | Robinson et al. | |
| 2015/0013270 | A1 * | 1/2015 | Chisholm | B65D 51/1683 53/420 |
| 2018/0078982 | A1 | 3/2018 | Siles et al. | |
| 2018/0093802 | A1 | 4/2018 | Taganuzzi | |
| 2018/0229900 | A1 | 8/2018 | Ross et al. | |
| 2018/0312307 | A1 | 11/2018 | Kittmann | |
| 2019/0084728 | A1 | 3/2019 | Bonfoey et al. | |
| 2019/0241332 | A1 | 8/2019 | Dunwoody | |

OTHER PUBLICATIONS

International Search Report and Written Opinion for International (PCT) Patent Application No. PCT/US2020/027679, dated Jun. 23, 2020 14 pages.

International Search Report and Written Opinion for International (PCT) Patent Application No. PCT/US2020/029789, dated Jul. 8, 2020 11 pages.

* cited by examiner

Section B-B

Section B-B

Section B-B

Section B-B

CHILDPROOF TAMPER EVIDENT CLOSURE ASSEMBLY

CROSS-REFERENCE TO RELATED APPLICATIONS

This application claims priority under 35 U.S.C. § 119(e) to U.S. Provisional Patent Application Ser. No. 62/833,304 filed Apr. 12, 2019, which is incorporated herein in its entirety by reference.

FIELD

The present disclosure relates generally to systems, methods, and apparatuses for sealing containers. More specifically, this disclosure provides a childproof overcap for use with bottles sealed by Roll-on Pilfer Proof (ROPP) closures.

BACKGROUND

Modern containers are used to store a variety of products including beverages and food products. Containers have a variety of shapes depending on the application. Some containers, such as beverage containers, have a bottle shape with a closed bottom portion, a generally cylindrical body portion, a neck portion with a reduced diameter extending upwardly from the body portion, and an opening positioned on an uppermost portion of the neck portion opposite to the closed bottom portion. Bottles may be formed from a variety of materials, including plastic, glass, and more commonly metal (including tin coated steel and aluminum). Methods and apparatuses of forming a threaded neck to receive a ROPP closure on a bottle formed of metal are generally described in U.S. Patent Publication Nos. 2014/0263150, 2018/0229900, and 2018/0078982, which are incorporated herein by reference in their entireties.

After being filled with a beverage or other product, bottles are typically sealed with a ROPP closure that may be used to selectively open and close the bottle. ROPP closures frequently include a tamper indicator or pilfer band releasably interconnected to a body of the ROPP closure. The pilfer band is adapted to separate from the closure body when the ROPP closure is at least partially rotated in an opening direction. When the ROPP closure is removed from the bottle, the pilfer band is retained on the neck of the bottle. In this manner, the pilfer band provides a visual safety indicator to the consumer that the bottle has been at least partially opened or that someone has tampered with the bottle.

Referring now to FIGS. 1A-1F, a process for capping a bottle 2 to generate and maintain an effective seal between the bottle 2 and a prior art ROPP closure 10 is provided. As shown in FIGS. 1A-1B, a ROPP shell 9 with an unthreaded body portion 12 is placed on the neck portion 4 of the bottle 2. A bottom portion of the ROPP shell 9 forms a pilfer band 18 that is releasably interconnected to the ROPP shell 9 by a serrated band 17. The ROPP shell 9 covers the bottle threads 8 with the pilfer band 18 extending downward past a skirt 30 of the bottle 2.

Referring now to FIG. 1C, a capping apparatus 22 subsequently performs three operations, including: (1) reforming the top portion 20 of the ROPP closure 10 to form a reform or channel 32; (2) forming threads 16 on a portion of the closure body 12; and (3) tucking the pilfer band 18 against the skirt 30 of the bottle 2. The timing and sequence of these three actions varies between different prior art capping apparatuses 22. Generally, one or more of a pressure block ejector 24 and a pressure block 25 apply a load, or "top load," to a top portion 20 of the ROPP closure 10 to press an outer edge of the top portion 20 down around a curl 6 of the bottle 2 creating a reform or channel 32 in the ROPP closure. An interior surface of the channel 32 applies force to a liner 14 within the ROPP closure 10. Accordingly, the liner 14 contacts an exterior of the bottle curl 6 to form an effective seal.

Once sealed, closure threads 16 are formed on the ROPP closure 10 to maintain the seal once the pressure block ejector 24 and the pressure block 25 are removed. The closure threads 16 are formed by a thread roller 26 that applies a "sideload" to the closure body 12. Typically, two thread rollers 26 are used. The thread rollers 26 use the underlying bottle threads 8 as a mandrel. The closure threads 16 are formed as the thread rollers 26 press against and chase down the body portion 12 along the bottle threads 8.

Two pilfer rollers 28 press inwardly against the bottle 2 to tuck the bottom edge of the ROPP closure 10 against a protrusion, known as the skirt 30, of the bottle 2. The pilfer rollers 28 also apply a sideload to the bottle 2 to tuck the pilfer band 18 against the bottle skirt 30. Some pilfer rollers 28 contact a portion of the bottle 2 while tucking the pilfer band 18. The pilfer band 18 is typically rolled inwardly at an angle of about 45° on the bottle 2. In this manner, if the ROPP closure 10 is rotated in an opening direction, the serrated band 17 is severed and the pilfer band 18 is retained on the bottle neck portion 4 to provide visual evidence of tampering. For most bottles 2, the bottle threads 8 are configured such that the opening direction of the ROPP closure 10 is counter-clockwise.

An example of a neck portion 4 of a metallic bottle 2 sealed by a ROPP closure 10 is illustrated in FIG. 1D. An expanded view of a portion of another embodiment of a prior art metallic bottle 2 is illustrated in FIG. 1E. The metallic bottle 2 is also shown sealed by another prior art ROPP closure 10 in FIG. 1F.

While current ROPP closures can identify to the consumer that the bottle has been at least partially opened or that the bottle has been tampered or altered, current ROPP closures cannot prevent the unauthorized opening of the bottle, particularly by children. Bottles and other containers may have contents that are potentially hazardous when consumed by children or others. In addition, children or others may not be able to read warning labels on the bottle, and therefore, cannot appreciate that consumption of potentially hazardous contents would be dangerous.

Due to the limitations and shortcomings associated with current ROPP closures and methods and apparatuses used to seal a bottle with current ROPP closures, there is an unmet need for a new tamper evidence device which may be used with a bottle sealed with a ROPP closure and that may include one or more childproof features to prevent unauthorized opening of the bottle.

SUMMARY

The present disclosure provides a childproof overcap that can be included with a ROPP closure and bottle. The childproof overcap can be positioned over a ROPP closure that seals a bottle, and the childproof overcap selectively transmits torque to the ROPP closure. With this arrangement, children or others would not be able to open the ROPP closure and access the potentially hazardous contents of the bottle without specific knowledge of how to engage the overcap with the ROPP closure and then open the ROPP closure and bottle.

In some embodiments, the overcap has a lower end that retains and secures the overcap to the ROPP closure. The overcap, like the ROPP closure and the bottle, generally extends along a longitudinal axis and a radial direction that is substantially perpendicular to the longitudinal axis. The lower end extends from the body of the overcap inwardly in the radial direction, and the lower end is positioned below a retainer band of the ROPP closure to secure the overcap to the ROPP closure. In addition, the arrangement of the lower end allows the overcap to move relative to the ROPP closure in the longitudinal axis. The overcap can move to a first position or mode of operation relative to the ROPP closure where the overcap does not engage the ROPP closure, and the overcap can freely rotate about the ROPP closure. Thus, a child cannot simply turn the overcap to open the ROPP closure and access the contents of the container. The overcap can also move to a second position or mode of operation relative to the ROPP closure where the overcap engages the ROPP closure to transmit a twisting or torque force to the ROPP closure. Then, the ROPP closure breaks the serrated portion and opens the bottle on which the ROPP closure and the overcap are positioned.

In various embodiments, the overcap has a deflectable top portion to control the transition between modes of operation. In the first position or mode of operation, no force or little force is applied to the top portion and/or outer edge of the overcap. As a result, the top portion extends downward to contact the ROPP closure before a pliable portion of the overcap can engage the ROPP closure. In the second position or mode of operation, a force is applied to an outer edge of the overcap to flatten and deflect the top portion into a more planar shape. This deflection allows the pliable portion of the overcap to engage the ROPP closure and transmit a twisting, rotational, or torque force to the ROPP closure.

In some embodiments, the ROPP closure has a knurled pattern with at least one recess or at least one protrusion. The knurled pattern can have alternating protrusions and recesses that extend around a perimeter edge of the ROPP closure. This knurled pattern can be formed by pressing recesses into the ROPP closure with a punch, a roller, or other tool. Similarly, in other embodiments, the knurled pattern can be formed by creating the protrusions with a tool or tools. Further still, both the recesses and protrusions may be formed with a tool or tools. The knurled pattern creates a surface that is configured to engage part of the overcap, such as the pliable portion, in the second position or mode of operation so that rotation of the overcap transfers to the ROPP closure to open the ROPP closure.

In various embodiments, the overcap can be made from a variety of materials, including plastic and metal. The overcap may be made of plastic where the overcap can be positioned over the ROPP closure after the ROPP closure has been positioned on the bottle. As the overcap is pressed over the ROPP closure, a lower end of the overcap deflects outwardly. Once the lower end has passed an outwardly-extending retainer band of the ROPP closure, the lower end deflects back inwardly to secure the overcap to the ROPP closure. The overcap may also be made of metal. In these embodiments, the overcap can first be placed on the ROPP closure. Then, a tool or tools such as rollers may bend a lower end of the overcap inwardly in a radial direction and at a position below the retainer band of the ROPP closure to secure the overcap to the ROPP closure.

In one embodiment, the tamper evidence device comprises one or more of a paper, a metal, a plastic, an adhesive, and a paint. In another embodiment, the tamper evidence device comprises one of a tamper bead, a pilfer strip generally vertically oriented with respect to the bottle, a pilfer strip generally aligned with a diameter of a neck portion of the bottle, a pilfer wrap at least partially shrunk around the ROPP closure, a pilfer wrap adhered to the bottle, and a pilfer overcap. In one embodiment, the pilfer overcap include an inwardly oriented protrusion that engages the annular ring formed in the bottle neck.

In one embodiment, the bottle is configured to store a pressurized product. In another embodiment, the bottle can store a pressurized product with a maximum internal pressure of up to about 100 pounds per square inch without unintended venting of product from the bottle. In yet another embodiment, the maximum internal pressure is up to about 135 pounds per square inch without failure or blow-off of a ROPP closure of the present disclosure.

In various embodiments, the addition of the overcap to the ROPP closure can be part of other manufacturing processes. For example, the ROPP closure may be positioned onto a bottle to seal the bottle, and the sealed bottle can undergo retort and/or pasteurization processes to sterilize the contents of the bottle. Next, an overcap can be snapped onto or formed on the ROPP closure. It will be appreciated that the overcap can first be snapped onto or formed on the ROPP closure before the sterilization process.

In some embodiments, various aspects of the present disclosure can be applied to closures other than a ROPP closure. For instance, an overcap can be positioned or formed over a lid, a cover, a cap, or any other type of structure that is configured to selectively enclose an opening of a container.

One embodiment of the present disclosure is a closure system for a container, comprising a container having a longitudinal axis and a radial direction that is oriented substantially perpendicular to the longitudinal axis, wherein a neck of the container has an opening positioned on an uppermost portion of the neck; a closure positioned on the neck of the container to seal the opening, the closure having a retainer band extending outwardly in the radial direction; an overcap positioned on the closure, the overcap having a lower end positioned proximate to the retainer band of the closure and extending inwardly in the radial direction to secure the overcap to the closure, wherein the overcap has a pliable portion positioned on an interior surface of the overcap; wherein, in a first mode of operation, the pliable portion of the overcap is in a non-engaging position with the closure such that rotation of the overcap is not translated to the closure; and wherein, in a second mode of operation, the overcap is lowered relative to the closure and the container, and the pliable portion of the overcap is in an engaging position with the closure to translate rotation of the overcap to the closure and separate the closure from the opening of the neck.

In some embodiments, the system further comprises at least one recess positioned on an outer perimeter of the closure, wherein the pliable portion of the overcap engages the at least one recess in the second mode of operation such that rotation of the overcap is translated to the closure. In various embodiments, the at least one recess is part of a knurled pattern that has alternating protrusions and recesses extending about the outer perimeter of the closure. In some embodiments, the closure is a roll-on pilfer proof (ROPP) closure, the ROPP closure comprises a shell covering the opening of the neck; a pilfer band positioned below a skirt of the neck, and the pilfer band extends inwardly in the radial direction to secure the pilfer band to the neck; and a serrated portion that selectively connects the pilfer band to the shell, wherein, in the second mode of operation, the translation of rotation of the overcap to the ROPP closure breaks the serrated portion. In various embodiments, the serrated portion is positioned between the retainer band and the pilfer band.

In some embodiments, the retainer band comprises at least one fold to extend the retainer band outward in the radial direction. In various embodiments, the system further comprises a coating on the closure to increase friction with the pliable portion of the overcap in the second mode of operation. In some embodiments, a top portion of the overcap is deflectable from an initial shape in the non-engaging position to a substantially planar shape in the engaging position.

Another particular embodiment of the present disclosure is a method of filling and assembling a container, a roll-on pilfer proof (ROPP) closure, and a safety overcap, comprising (i) filling a container with contents, wherein the container has a sidewall and a neck extending upwardly therefrom, the sidewall and the neck oriented along a longitudinal axis, and a radial direction is oriented substantially perpendicular to the longitudinal axis, wherein a skirt of the container extends outwardly from the neck in the radial direction; (ii) positioning a ROPP closure on the container, wherein a pilfer band of the ROPP closure extends inwardly in the radial direction and is positioned below the skirt of the container to secure the ROPP closure to the container and seal the contents in the container, wherein a retainer band of the ROPP closure extends outwardly in the radial direction; and (iii) positioning an overcap on the ROPP closure, wherein a lower end of the overcap extends inwardly in the radial direction and is positioned proximate to the retainer band of the ROPP closure to secure the overcap to the ROPP closure, wherein the overcap is movable between a non-engaging position relative to the ROPP closure where rotation of the overcap is not translated to the ROPP closure and an engaging position relative to the ROPP closure where rotation of the overcap is translated to the ROPP closure.

In some embodiments, the method further comprises (iv) pressing the overcap over the ROPP closure such that the lower end deflects outwardly in the radial direction on an outer surface of the ROPP closure; and (v) moving the overcap along the ROPP closure in the longitudinal axis such that the lower end passes the retainer band of the ROPP closure, and the lower end deflects inwardly in the radial direction to secure the overcap to the ROPP closure. In various embodiments, the method further comprises (vi) positioning the overcap over the ROPP closure such that the lower end is positioned below the retainer band of the ROPP closure; and (vii) deforming the lower end inwardly in the radial direction to secure the overcap to the ROPP closure.

In various embodiments, at least one roller deforms the lower end. In some embodiments, the method further comprises (viii) forming at least one recess on an outer surface of the ROPP closure to receive a portion of the overcap in the engaging position such that rotation of the overcap is translated to the ROPP closure. In various embodiments, the at least one recess is part of a knurled pattern of alternating recesses and protrusions that extend about a perimeter of the ROPP closure. In some embodiments, the method further comprises (ix) positioning a pliable portion on an interior surface of a top portion of the overcap, wherein the pliable portion contacts the ROPP closure in the engaging position such that rotation of the overcap is translated to the ROPP closure.

A further embodiment of the present disclosure is an overcap for a roll-on pilfer proof (ROPP) closure having a retainer band extending outwardly in a radial direction, comprising a top portion that is deflectable from an initial shape in a first mode of operation to a substantially planar shape in a second mode of operation; a sidewall extending downwardly from the top portion, the sidewall and the top portion defining an interior volume; an engagement feature connected to the top portion and positioned in the interior volume; a lower end of the sidewall extending inwardly in the radial direction, and the lower end configured to secure the overcap on the retainer band of the ROPP closure; wherein, in the first mode of operation, the engagement feature of the overcap is configured to be in a non-engaging position with the ROPP closure such that rotation of the overcap does not transmit torque to the ROPP closure; and wherein, in the second mode of operation, the engagement feature of the overcap is configured to be in an engaging position with the ROPP closure such that the overcap is configured to transmit torque to the ROPP closure.

In various embodiments, a center of the top portion is configured to contact the ROPP closure in the first mode of operation. In some embodiments, the engagement feature is a pliable material that extends from an interior surface of the overcap. In various embodiments, the pliable material forms an annular ring. In some embodiments, the overcap comprises at least one of a metallic material or a plastic material.

Although generally referred to herein as a "bottle," "beverage bottle," "metallic beverage bottle," "metallic container," "beverage container," "aluminum bottle," "can," and "container," it should be appreciated that the methods and apparatus described herein may be used with containers of any size or shape and that are formed of any material, including, but not limited to metal, plastic, and glass containers including, without limitation, beverage cans and beverage bottles. Accordingly, the term "container" is intended to cover containers of any type and formed of any material that are subsequently sealed with a Roll-on Pilfer Proof (ROPP) closure. Further, as will be appreciated by one of skill in the art, the methods and apparatus of the present disclosure may be used for any type of threaded container and are not specifically limited to a beverage container such as a soft drink or beer can.

The terms "metal" or "metallic" as used hereinto refer to any metallic material that may be used to form a container, including without limitation aluminum, steel, tin, and any combination thereof. However, it will be appreciated that the apparatus and methods of the present disclosure may be used with threaded containers formed of any material, including paper, plastic, and glass.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description, Abstract, and Claims themselves.

The Summary is neither intended, nor should it be construed, as being representative of the full extent and scope of the present disclosure. Moreover, references made herein to "the present disclosure" or aspects thereof should be understood to mean certain embodiments of the present disclosure and should not necessarily be construed as limiting all embodiments to a particular description. The present disclosure is set forth in various levels of detail in the Summary as well as in the attached drawings and the Detailed Description and no limitation as to the scope of the present disclosure is intended by either the inclusion or non-inclusion of elements or components. Additional aspects of the present disclosure will become more readily apparent from the Detailed Description, particularly when taken together with the drawings.

BRIEF DESCRIPTION OF THE DRAWINGS

The accompanying drawings, which are incorporated herein and constitute a part of the specification, illustrate embodiments of the disclosure and together with the Summary given above and the Detailed Description given below serve to explain the principles of these embodiments. In certain instances, details that are not necessary for an understanding of the disclosure or that render other details difficult to perceive may have been omitted. It should be understood, of course, that the present disclosure is not necessarily limited to the particular embodiments illustrated herein. Additionally, it should be understood that the drawings are not necessarily to scale.

Figure 1A:
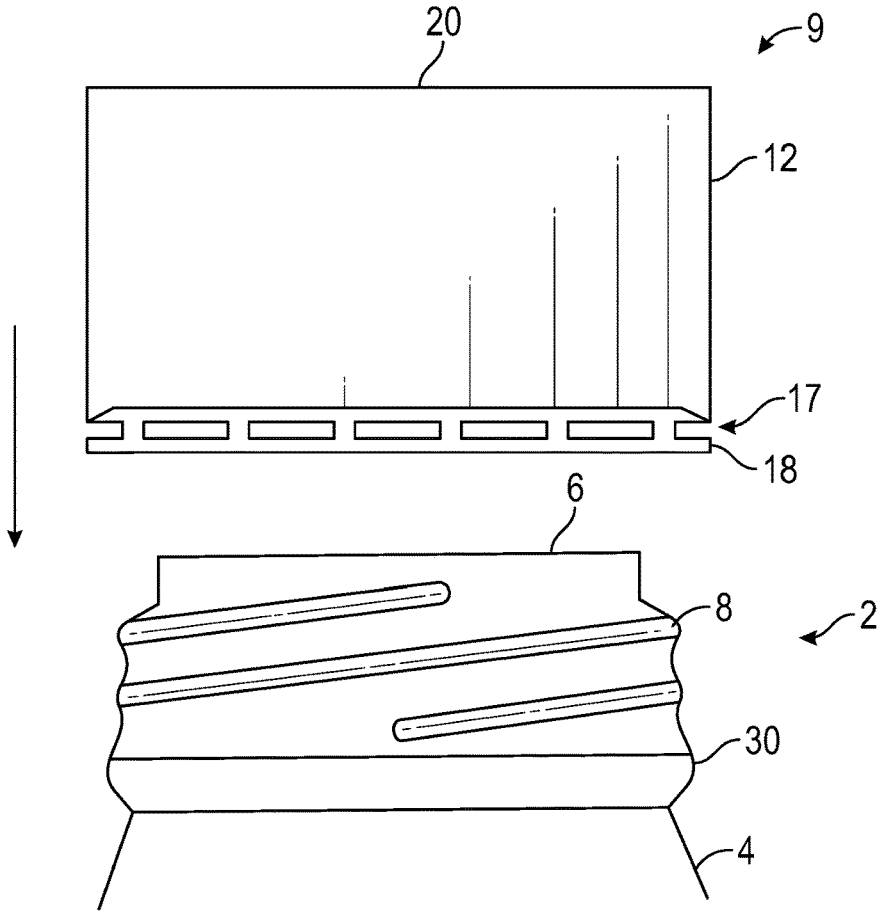
FIG. 1A (Prior Art)
FIGS. 1A-1D illustrate a process of sealing a metallic bottle with a ROPP closure using a prior art capping apparatus.
Figure 1B:
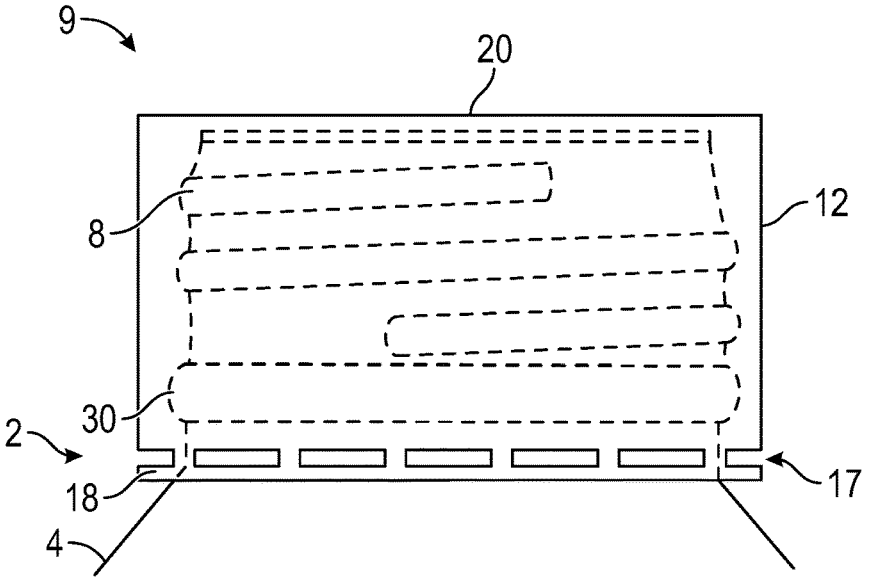
FIG. 1B (Prior Art)
Figure 1C:
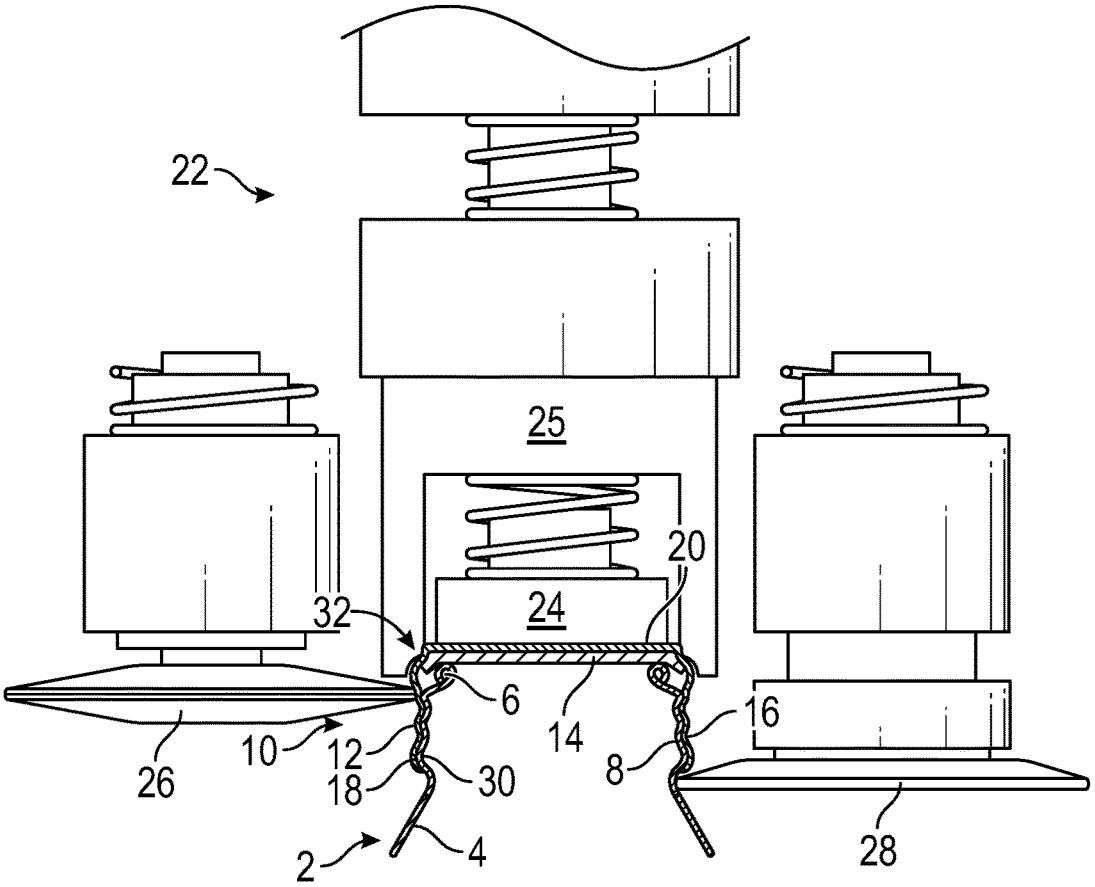
FIG. 1C (Prior Art)
Figure 1D:
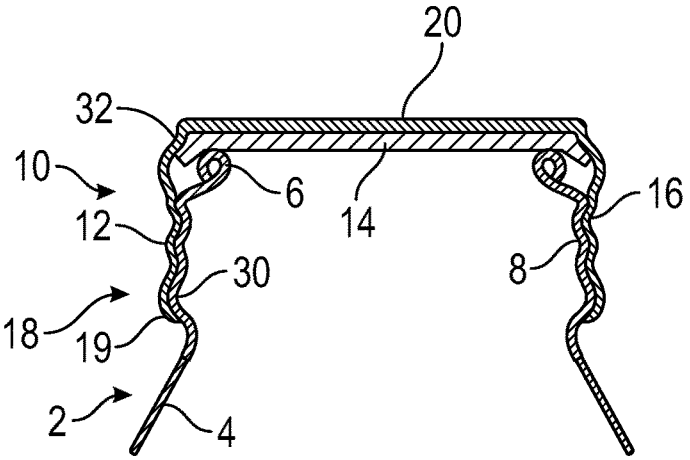
FIG. 1D (Prior Art)
Figure 1E:
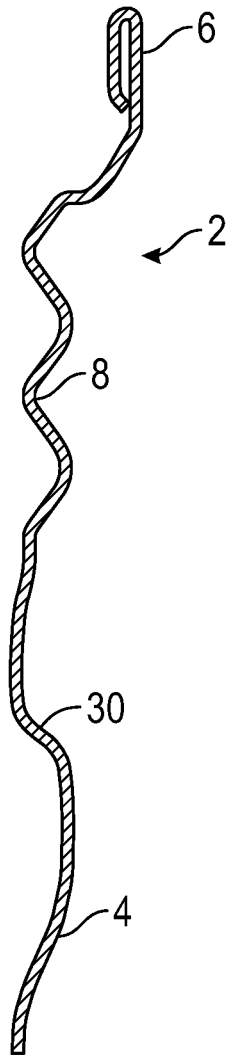
FIG. 1E (Prior Art)
FIG. 1E is a partial cross-sectional front elevation view of a portion of a prior art metallic bottle before the metallic bottle is sealed with a prior art ROPP closure.
Figure 1F:
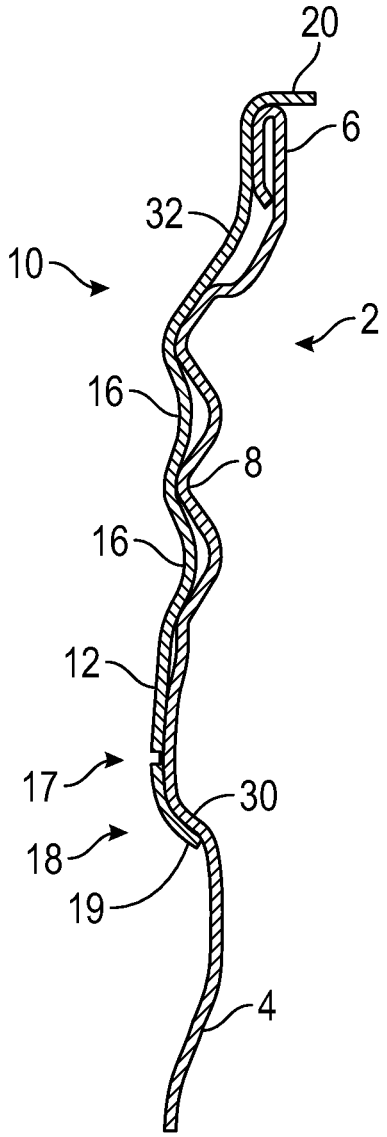
FIG. 1F (Prior Art)
FIG. 1F is another partial cross-sectional front elevation view of the prior art metallic bottle of FIG. 1E after the metallic bottle has been sealed with the prior art ROPP closure.

To assist in the understanding of one embodiment of the present disclosure the following list of components and associated numbering found in the drawings is provided herein:

| Number | Component |
|---|---|
| 2 | Bottle of the prior art |
| 4 | Neck portion |
| 6 | Curl |
| 8 | Bottle threads |
| 9 | ROPP shell |
| 10 | ROPP closure |
| 12 | Body portion of ROPP closure |
| 14 | ROPP liner |
| 16 | Closure threads |
| 17 | Serrated band |
| 18 | Pilfer band |
| 19 | Bottom edge of pilfer band |
| 20 | Top portion of ROPP closure |
| 22 | Prior art capping apparatus |
| 24 | Pressure block ejector |
| 25 | Pressure block |
| 26 | Thread roller |
| 28 | Pilfer roller |
| 30 | Skirt of metallic bottle |
| 32 | Channel of closure |
| 36 | Bottle |
| 38 | Longitudinal Axis |
| 40 | Radial Direction |
| 42 | Neck |
| 44 | Skirt |
| 46 | Thread |
| 48 | Curl |
| 50 | Opening |
| 52 | ROPP Closure |
| 54 | Body |
| 56 | Thread |
| 58 | Liner |
| 60 | Pilfer Band |
| 62 | Serrated Portion |
| 64 | Retainer Band |
| 66 | Knurled Pattern |
| 68 | Overcap |
| 70 | Body |
| 72 | Lower End |
| 74 | Deflection Angle |
| 76 | Top Portion |
| 78 | Pliable Portion |
| 80 | First Distance |
| 82 | Lock Protrusion |
| 84 | Lock Recess |
| 86 | Second Distance |

DETAILED DESCRIPTION

The present disclosure has significant benefits across a broad spectrum of endeavors. It is the Applicant's intent that this specification and the claims appended hereto be accorded a breadth in keeping with the scope and spirit of the disclosure being disclosed despite what might appear to be limiting language imposed by the requirements of referring to the specific examples disclosed. To acquaint persons skilled in the pertinent arts most closely related to the present disclosure, a preferred embodiment that illustrates the best mode now contemplated for putting the disclosure into practice is described herein by, and with reference to, the annexed drawings that form a part of the specification. The exemplary embodiment is described in detail without attempting to describe all of the various forms and modifications in which the disclosure might be embodied. As such, the embodiments described herein are illustrative, and as will become apparent to those skilled in the arts, may be modified in numerous ways within the scope and spirit of the disclosure.

Referring now to FIGS. 1A-1F, a prior art method of sealing a ROPP closure 10 on a threaded neck of a metallic bottle 2 is provided.

Figure 2:
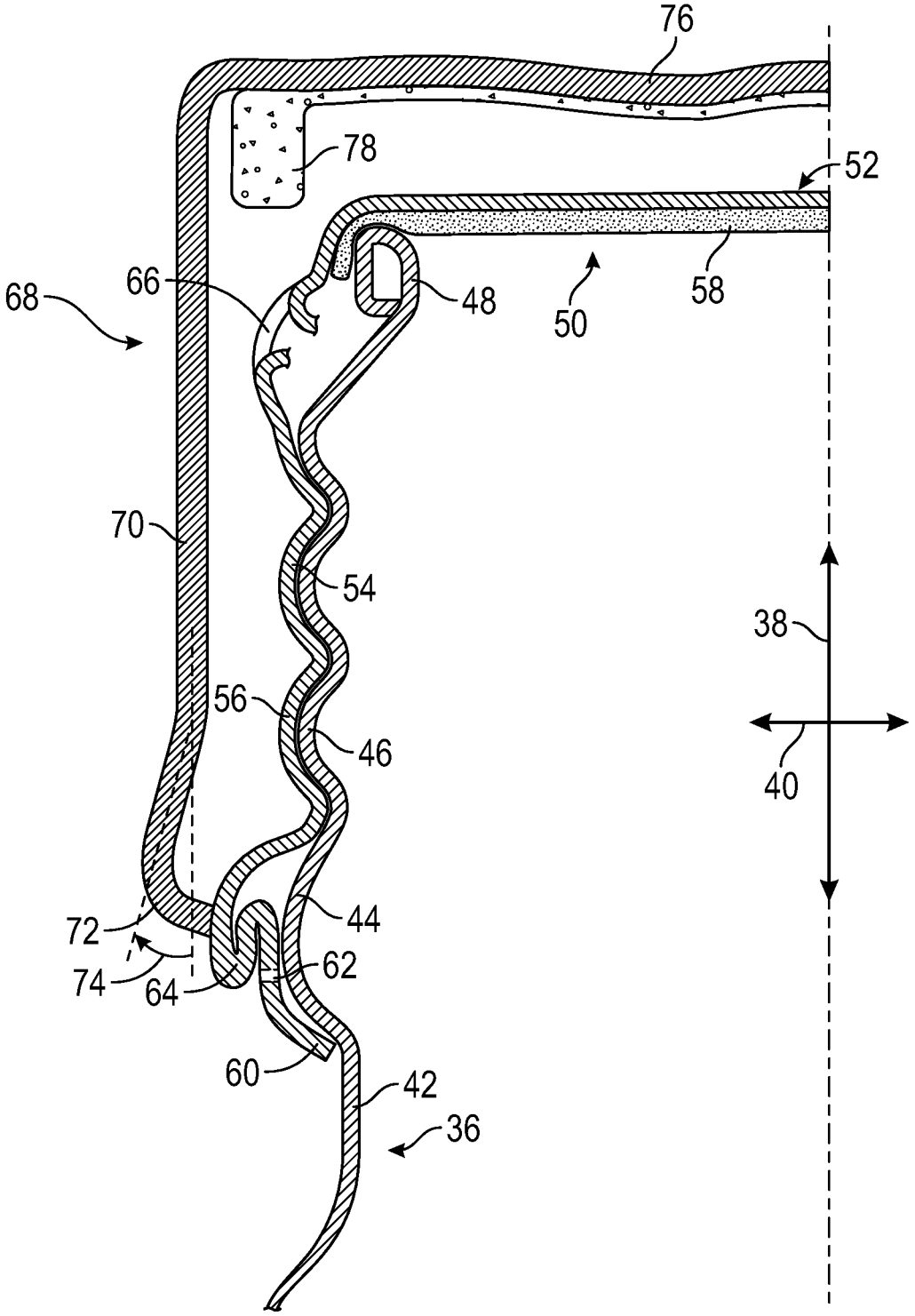
FIG. 2 is a cross-sectional front elevation view of a bottle sealed with a ROPP closure and with a childproof overcap in the process of being positioned on the ROPP closure in accordance with an embodiment of the present disclosure.

Referring now to FIG. 2, a cross-sectional view of a bottle 36, a ROPP closure 52, and an overcap 68 is provided where the ROPP closure 52 is positioned on the bottle 36, and the overcap 68 is in the process of being positioned on the ROPP closure 52. The bottle 36 is generally oriented along a longitudinal axis 38 and a radial direction 40 that is substantially perpendicular to the longitudinal axis 38. The bottle 36 has a neck 42 extending upward along the longitudinal axis 38, and the neck 42 has a skirt 44 that extends outwardly in the radial direction 40 to secure the ROPP closure 52. The neck 42 also has a thread 46 that extends around the neck 42 and along the neck 42 in the longitudinal axis 38. The thread 46 engages a corresponding thread on the ROPP closure 52 so that the ROPP closure 52 can be selectively opened and closed on the bottle 36. A curl 48 is formed at an uppermost end of the neck 42 to define an opening 50 of the bottle 36 and to provide a suitable surface for contacting the mouth of a user when the user consumes the contents of the bottle 36.

Next, the ROPP closure 52 has several features that seal the bottle 36 and provide additional functions. The ROPP closure 52 has a body 54 with a thread 56 that engages the thread of the bottle 36 to provide the selective opening and closing of the ROPP closure 52. A liner 58 is positioned on an interior surface of the ROPP closure 52 at an uppermost end of the ROPP closure 52. The liner 58 presses into the curl 48 to seal the ROPP closure 52 against the curl 48 and seal the opening 50 of the bottle 36. Next, the ROPP closure 52 has a pilfer band 60 that is attached to the body 54 by a serrated portion 62. The pilfer band 60 in this embodiment is positioned at the lowermost end of the ROPP closure 52 and positioned below the skirt 44 of the bottle 36, and the pilfer band 60 extends inwardly in the radial direction 40 to secure the pilfer band 60 to the bottle 36. The pilfer band 60 can be deflected into place below the skirt 44 or, for example, the pilfer band 60 can be formed after the ROPP closure 52 is positioned on the bottle 36. The serrated portion 62 has at least one perforation such that the serrated portion 62 breaks when subjected to a predetermined twisting or torque force. During operation, a user rotates the ROPP closure 52, and the threads 56, 46 engage each other to urge the ROPP closure 52 away from the bottle 36. The force increases until the serrated portion 62 breaks, leaving the pilfer band 60 in place below the skirt 44 as an indication that the bottle 36 has been opened.

The ROPP closure 52 also has a retainer band 64 and a knurled pattern 66 that interact with features of the overcap 68 to provide various functions. Like the outwardly-extending skirt 44 on the bottle 36, the retainer band 64 extends outwardly in the radial direction 40 to help secure the overcap 68 to the ROPP closure 52. In this embodiment, the retainer band 64 is a double folded portion of the ROPP closure 52 positioned above the serrated portion 62. In other embodiments, it will be appreciated that the retainer band 64 may be a portion of the ROPP closure 52 that forms a partially or continuous protrusion or other feature that extends in an outwardly, radial direction. The knurled pattern 66 selectively engages the overcap 68 so that the overcap 68 can selectively transmit a twisting or torque force to the ROPP closure 52, which provides the childproof feature of the assembly. In this embodiment, the knurled pattern 66 has alternating protrusions and recesses that extend around the ROPP closure 52.

Still referring to FIG. 2, the overcap 68 has a body 70 with a lower end 72 that extends inwardly in the radial direction 40 at a position below the retainer band 64 of the ROPP closure 52. As shown, the overcap 68 is pressed onto the ROPP closure 52 such that the lower end 72 deflects outwardly at an angle 74. Once the lower end 72 passes the retainer band 64, the lower end 72 deflects back inwardly at a smaller angle 74 to secure the overcap 68 to the ROPP closure 52. The lower end 72 may be a continuous feature extending about a perimeter of the ROPP closure 52. In other embodiments, recesses or slots may be cut into the lower end 72 to allow portions of the lower end 72 between the recesses or slots to more easily deflect outwardly and inwardly.

It will be appreciated that the overcap 68 and other components may be made from a variety of materials. The overcap 68 may be made from plastic or another material that is capable of deflecting outwardly to pass over the ROPP closure 52 and then deflect inwardly to secure the overcap 68 to the ROPP closure 52. In some embodiments, the overcap 68 may be made from a metallic material. Like the formation of the ROPP closure 52 described in FIGS. 1A-1F, the overcap 68 may first be positioned over the ROPP closure 52. Then, rollers can form the lower end 72 below the retainer band 64 of the ROPP closure 52 to secure the overcap 68 to the ROPP closure 52.

Next, the overcap 68 has a top portion 76 and a pliable portion 78 that is at least partially positioned on the interior surface of the top feature 76. The pliable portion 78 is a deflectable and/or flexible material that, when pressed into the knurled pattern 66 of the ROPP closure 52, fills in the recesses of the knurled pattern 66 of the ROPP closure 52 so that the pliable portion 78 and knurled pattern 66 are engaged and rotation of the overcap 68 causes rotation of the ROPP closure 52. It will be appreciated that the pliable portion 78 may have an annular shape without a center to engage the corresponding annular shape of the other knurled pattern 66. In addition, it will be appreciated that in other embodiments, the pliable portion 78 may be connected to the interior surface of a sidewall of the overcap 68 in addition to or in place of the top portion 76.

In addition, the top portion 76 is selectively deflectable between modes of operation. In the absence of a load on the top portion 76, the top portion 76 extends downward so that the pliable portion 78 of the overcap 68 does not engage the knurled pattern 66 of the ROPP closure 52. When a load force is applied to an outer edge of the top portion 76, the top portion 76 flattens out into a more planar shape that allows the pliable portion 78 of the overcap 68 to reach and engage the knurled pattern 66.

Figure 3A:
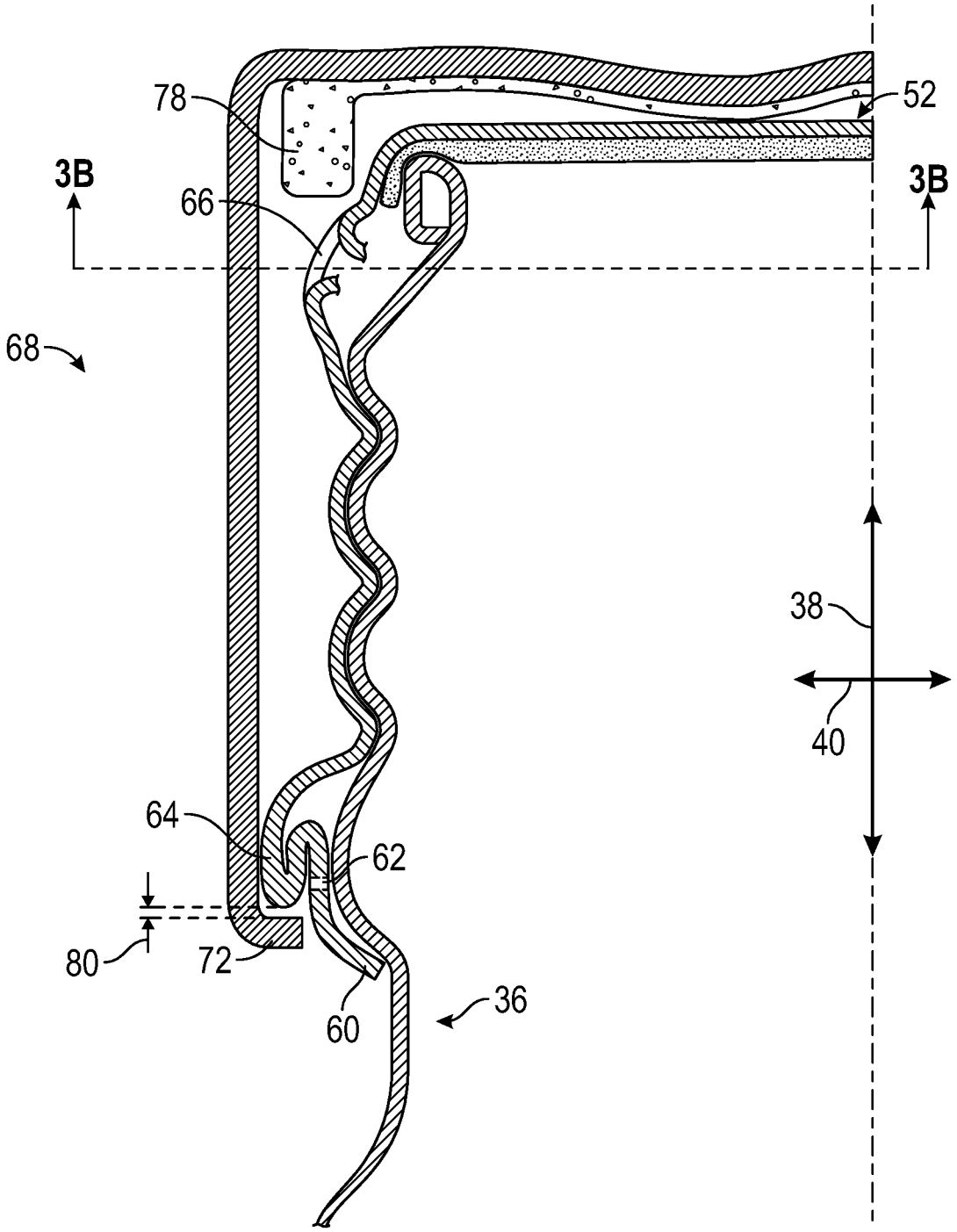
FIG. 3A is a cross-sectional front elevation view of a bottle sealed with a ROPP closure and with a childproof overcap positioned on the ROPP closure in accordance with an embodiment of the present disclosure.

Referring now to FIG. 3A, a cross-sectional view of the bottle 36, the ROPP closure 52, and the overcap 68 is provided. The lower end 72 of the overcap 68 has now passed the retainer band 64 such that the lower end 72 deflects inwardly to secure the overcap 68 to the ROPP closure 52. In the absence of a force, the top portion 76 is in a downward, non-deflected position such that the top portion 76, or at least the portion of the pliable portion 78 at the center of the top portion 76, contacts the top of the ROPP closure 52 before the outer portion of the pliable portion 78 can engage the knurled pattern 66 of the ROPP closure 52. In this mode of operation, the overcap 68 can rotate about the ROPP closure 52 without transmitting a twisting or torque force to the ROPP closure 52 to break the serrated portion 62. Thus, a child can turn the overcap without breaking a portion of the ROPP closure 52 and gaining access to the contents of the container. Moreover, the lower end 72 of the overcap 68 is a first distance 80 from the retainer band 64 of the ROPP closure 52 in the longitudinal axis 38. Also shown in FIG. 3A is line B-B.

Figure 3B:
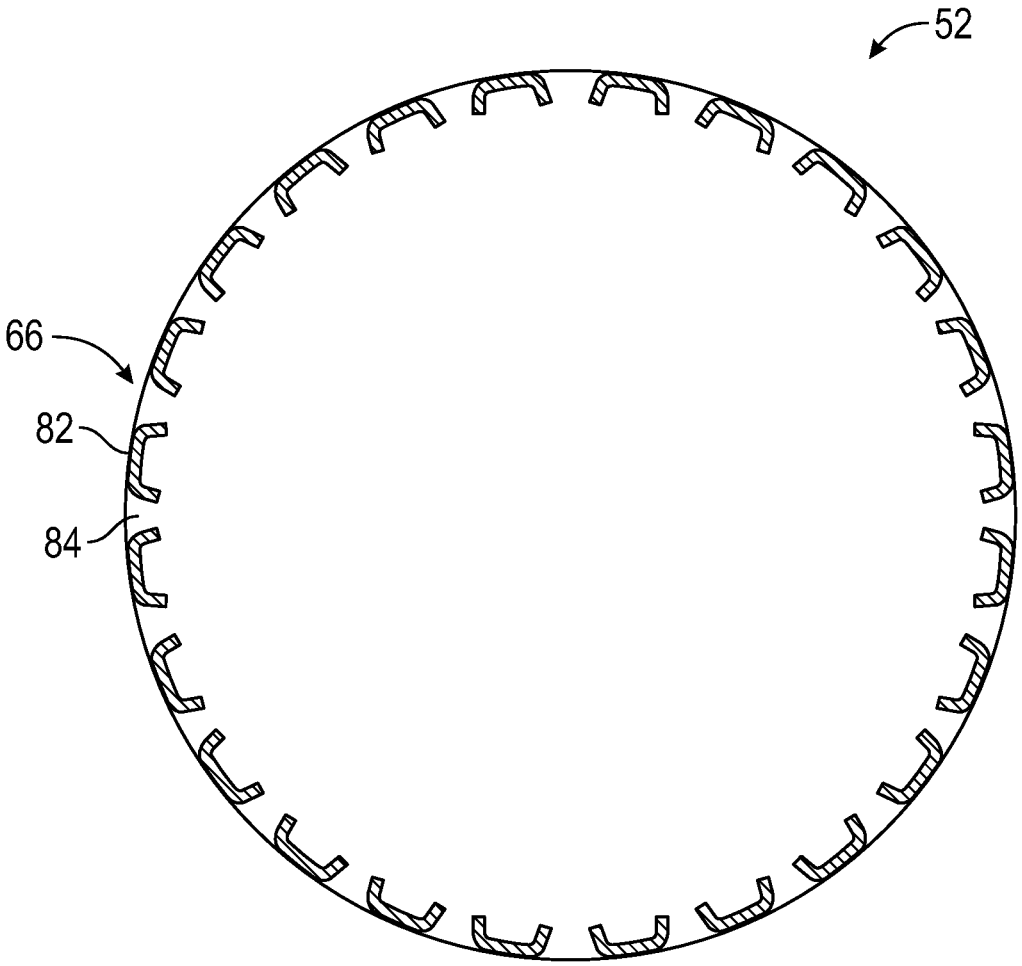
FIG. 3B is a cross-sectional top plan view of the ROPP closure of FIG. 3A taken along line B-B in accordance with an embodiment of the present disclosure.

Referring now to FIG. 3B, a cross-sectional view of the ROPP closure 52 taken along line B-B of FIG. 3A is provided. As discussed above, the knurled pattern 66 of the ROPP closure 52 in this embodiment has alternating protrusions 82 and recesses 84 extending around an outer edge of the ROPP closure 52.

Figure 4A:
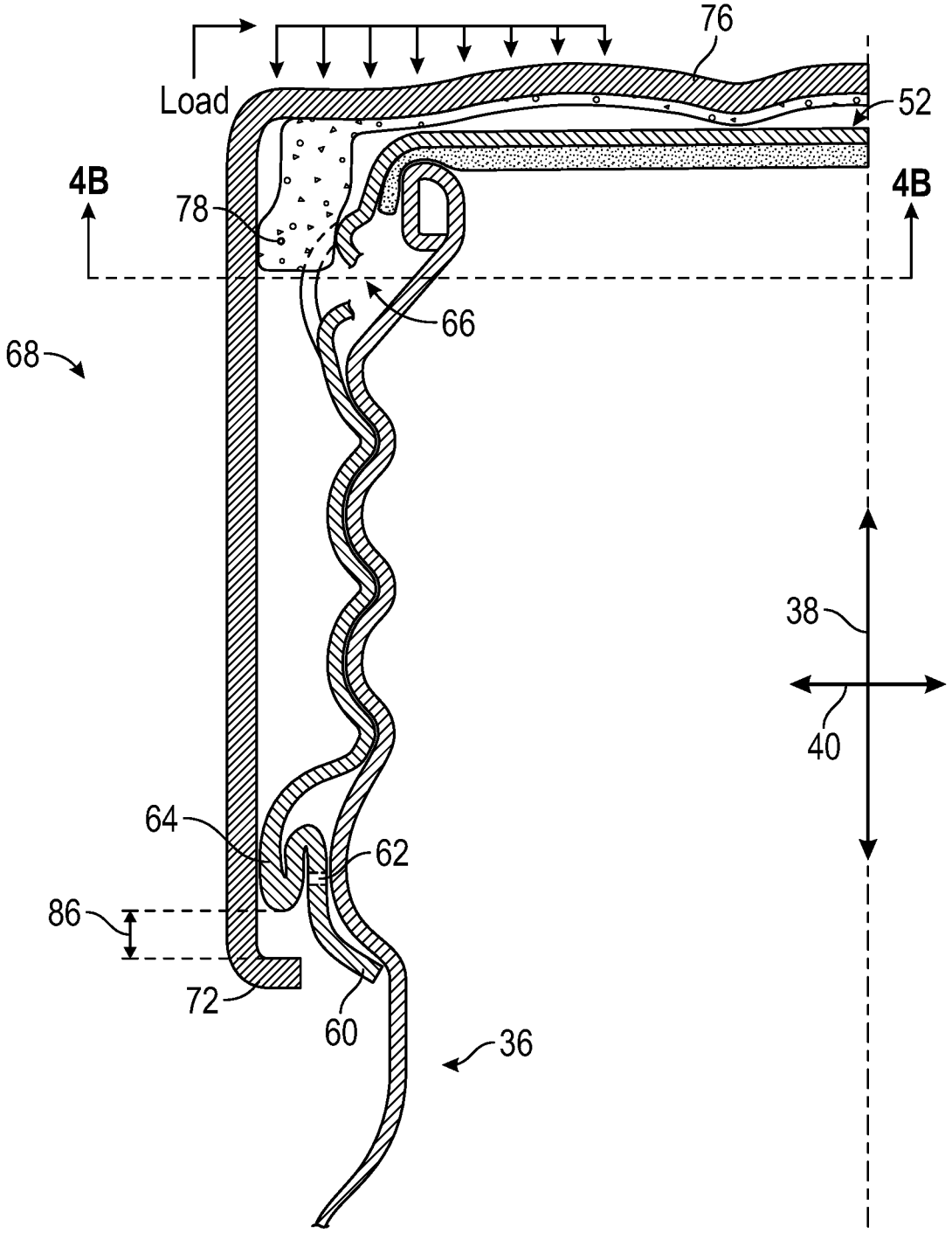
FIG. 4A is a cross-sectional front elevation view of a bottle sealed with a ROPP closure and a childproof overcap engaged with the ROPP closure in accordance with an embodiment of the present disclosure.

Referring now to FIG. 4A, a cross-sectional view of the bottle 36, the ROPP closure 52, and the overcap 68 is provided. This figure shows a force applied to an outer edge of the overcap 68 such that the top portion 76 deflects into a more planar shape. As a result of this deflection, the pliable portion 78 of the over cap 68 engages the knurled pattern 66 of the ROPP closure 52 such that a twisting or torque force imparted on the overcap 68 is transmitted to the ROPP closure 52. In addition, in this mode of operation, the overcap 68 moves downward relative to the ROPP closure 52 and the bottle 36 such that a second distance 86 between the lower end 72 of the overcap 68 and the retainer band 64 of the ROPP closure 52 is larger than the first distance. Also shown in FIG. 4A is line B-B.

Figure 4B:
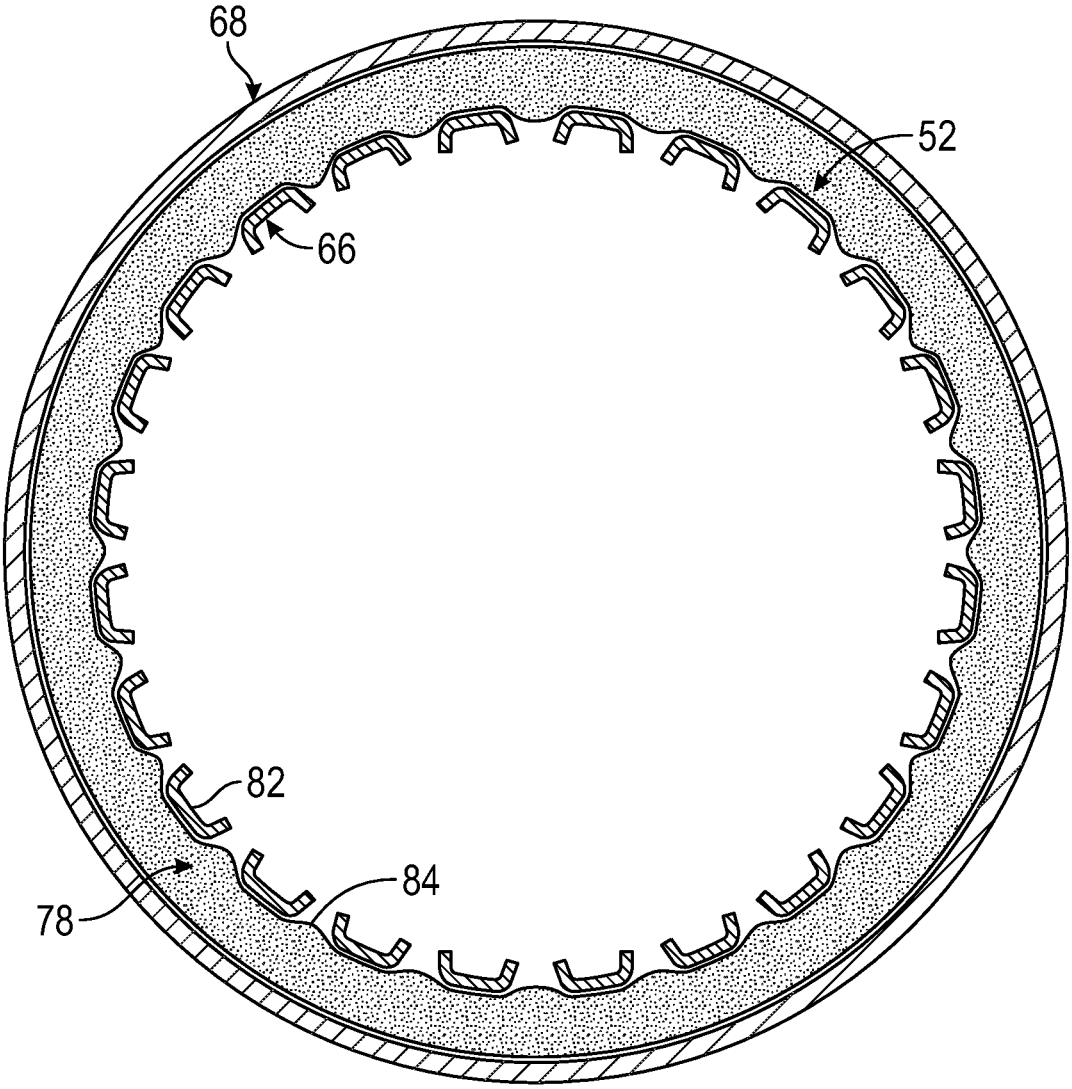
FIG. 4B is a cross-sectional top plan view of the ROPP closure and the overcap of FIG. 4A taken along line B-B in accordance with an embodiment of the present disclosure.

Referring now to FIG. 4B, a cross-sectional view of the overcap 68 and the ROPP closure 52 taken along line B-B of FIG. 4A is provided. As described above, the knurled pattern 66 of the ROPP closure has alternating protrusions 82 and recesses 84. The pliable portion 78 of the overcap 68 is pressed into the knurled pattern 66 of the ROPP closure 52 where the pliable and/or flexible material of the pliable portion 78 extends into the recesses 84 of the other knurled pattern 66. For example, the pliable and/or flexible material may be a low durometer elastomer material in some embodiments. This allows a twisting or torque force from the overcap 68 to transmit to the ROPP closure. While this embodiment has a pliable portion 78 engaging a more rigid knurled pattern 66, other embodiments may include two pliable lock features or two rigid lock features. Furthermore, some embodiments may include only one lock feature positioned on the overcap or the ROPP closure. For example, an exemplary embodiment may include a pliable portion 78 on the overcap 68 that engages a conventional ROPP closure 52 that does not have a knurled pattern 66. The conventional ROPP closure 52 may be smooth and featureless where the pliable portion 78 pushes into the ROPP closure 52 to transmit torque. In other embodiments, the ROPP closure 52 may have a coating to increase friction with the pliable portion 78.

Figure 5:
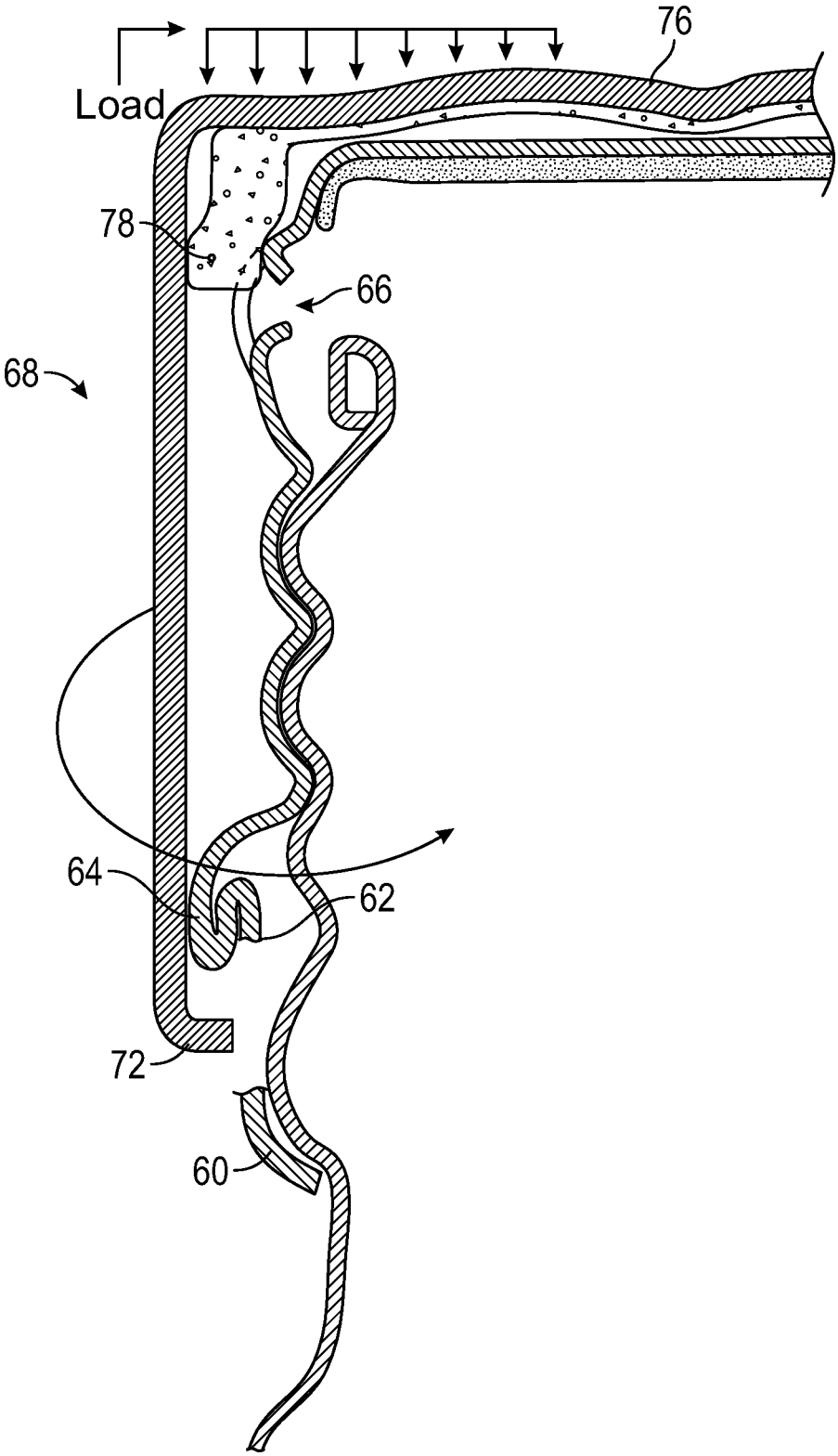
FIG. 5 is a cross-sectional front elevation view of a bottle where rotation of the overcap has caused the serrated portion of the ROPP closure to break and open the bottle in accordance with an embodiment of the present disclosure.

Referring now to FIG. 5, a cross-sectional view of the bottle 36, the ROPP closure 52, and the overcap 68 is provided. This figure shows a twisting or torque force applied to the overcap 68 imparted to the ROPP closure 52 during the second mode of operation. A user presses down on an outer edge of the overcap 68 to deflect the top portion 76, which engages the pliable portion 78 and knurled pattern 66. Then, or simultaneously, the user rotates the overcap 68 to transmit force to the ROPP closure 52. The ROPP closure 52 rotates against the bottle 36 to break the serrated portion 62, opening the bottle 36 and leaving behind a pilfer band 60 on the bottle 36 to indicate that the bottle 36 has been opened.

Figure 6A:
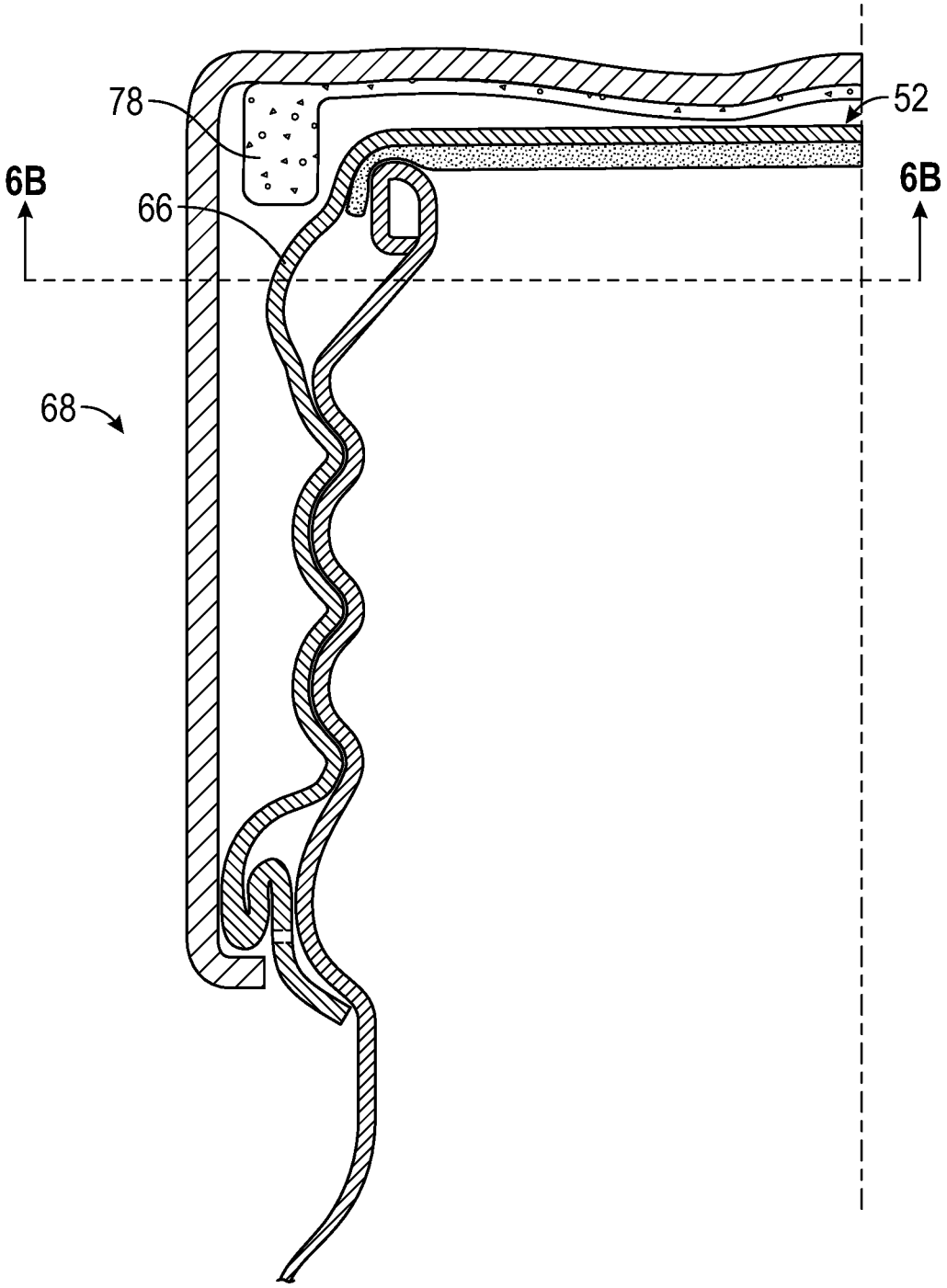
FIG. 6A is a cross-sectional front elevation view of a bottle sealed with a deflectable ROPP closure and with a childproof overcap positioned on the ROPP closure in accordance with an embodiment of the present disclosure.
Figure 6B:
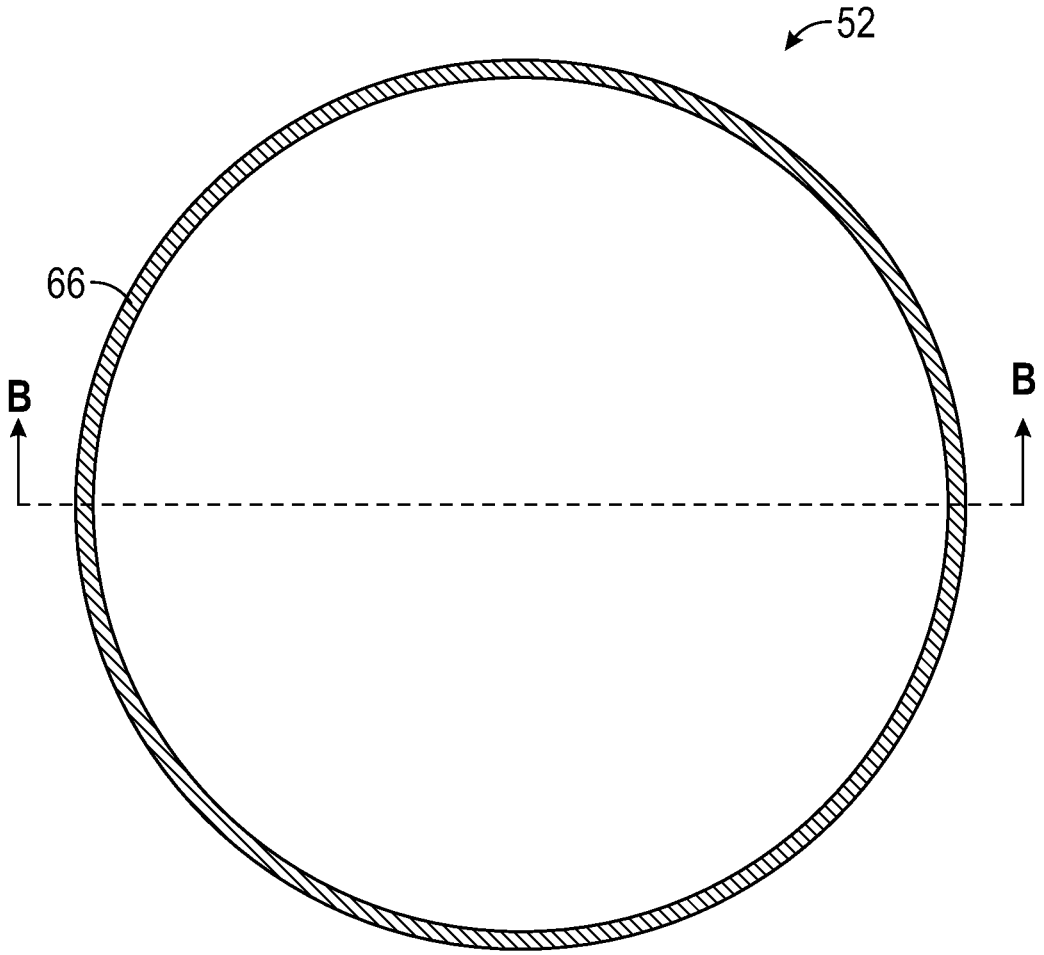
FIG. 6B is a cross-sectional top plan view of the deflectable ROPP closure of FIG. 6A taken along line B-B in accordance with an embodiment of the present disclosure.

Now referring to FIGS. 6A-7B, various views of another embodiment of the disclosure are provided. In these embodiments, the lock feature 66 of the ROPP closure 52 is a deflectable area instead of alternating protrusions and recesses in a knurled pattern. Therefore, as shown in FIG. 6A, the lock feature 66 of the ROPP closure 52 is in a non-deflected state, and the overcap 68 can rotate about the ROPP closure 52 as described in other embodiments. FIG. 6B is a cross-sectional view of the ROPP closure 52 and the deflectable lock feature 66 taken along line B-B in FIG. 6A. As depicted, the deflectable lock feature 66 continuously extends around a perimeter of the ROPP closure 52, but it will be appreciated that the lock feature 66 may have alternating deflectable and non-deflectable portions extending around the perimeter, in some embodiments.

Figure 7A:
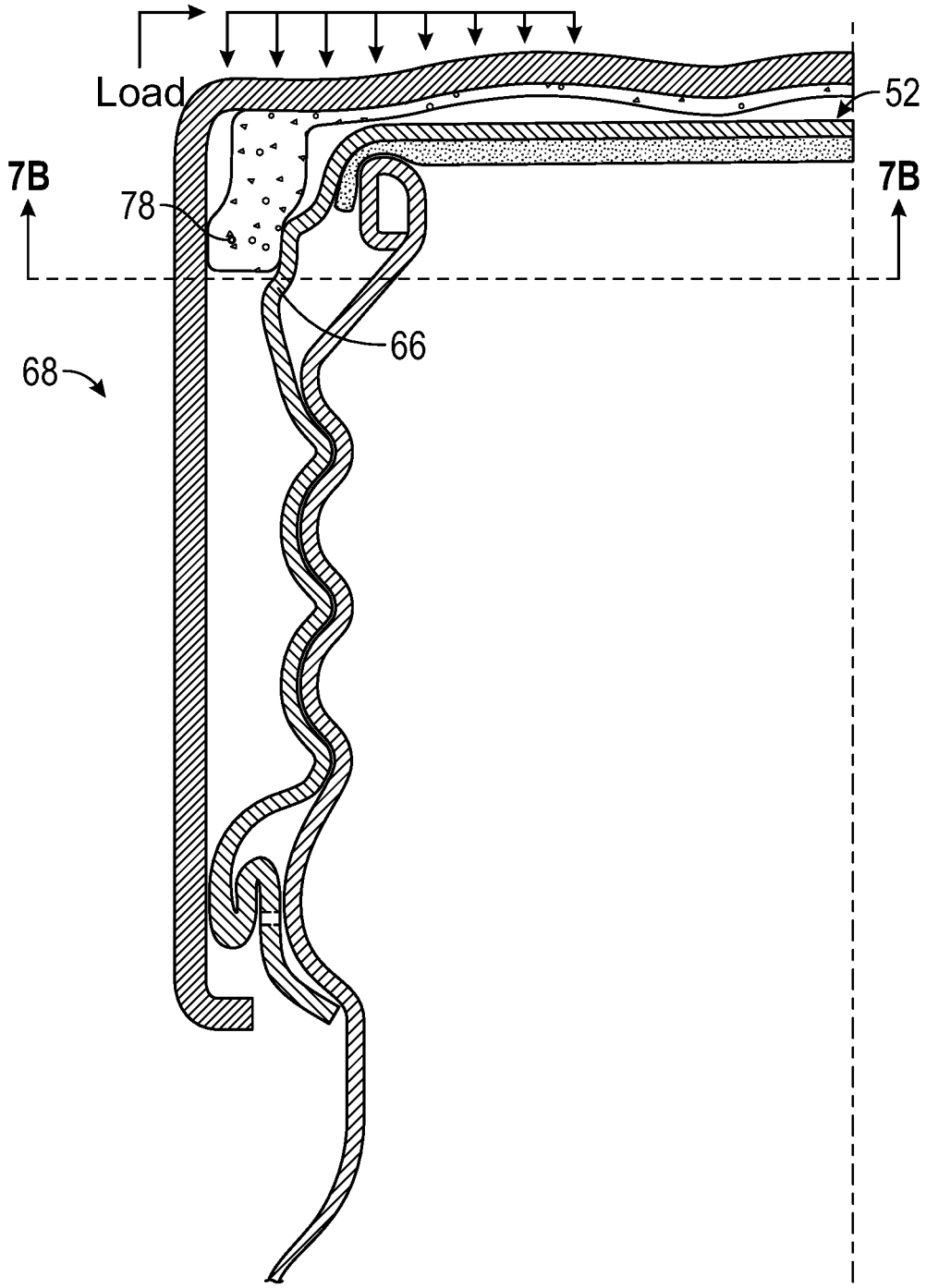
FIG. 7A is a cross-sectional front elevation view of a bottle sealed with a deflectable ROPP closure and a childproof overcap engaged with the ROPP closure in accordance with an embodiment of the present disclosure.
Figure 7B:
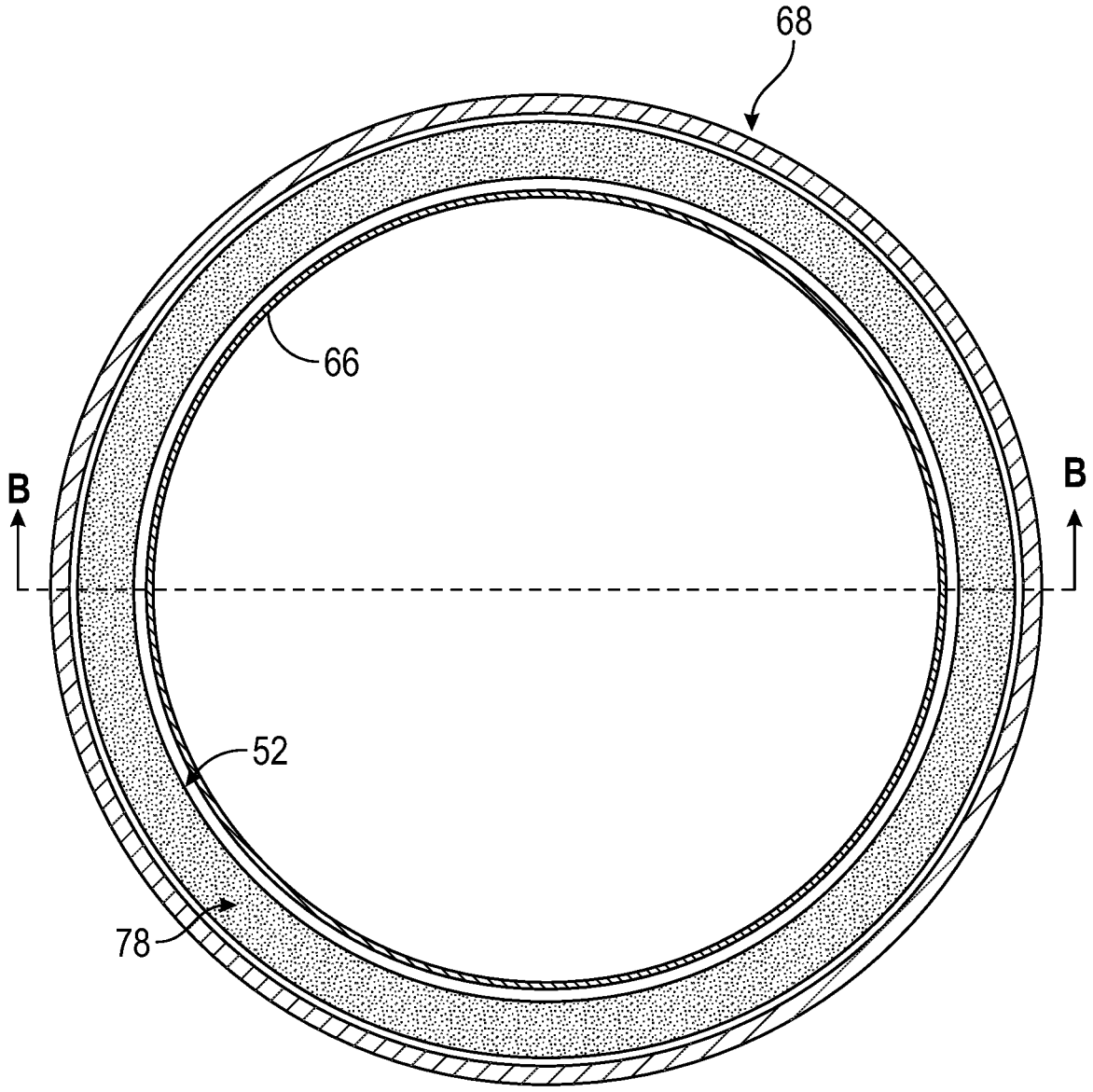
FIG. 7B is a cross-sectional top plan view of the deflectable ROPP closure and the overcap of FIG. 7A taken along line B-B in accordance with an embodiment of the present disclosure.

As shown in FIG. 7A, as the lock feature 78 of the overcap 68 presses downward to the second position or mode of operation where the lock features 66, 78 engage such that rotation of the overcap 68 is transmitted to the ROPP closure 52. In this mode of operation, the lock feature 66 of the ROPP closure 52 is deflected inward to accommodate the lock feature 78 of the overcap 68. The deflection of the lock feature 66 of the ROPP closure 52 allows the other lock feature 78 to engage and generate a sufficient amount of friction to transmit torque or rotational forces. FIG. 7B is a cross-sectional view of the ROPP closure 52 and the deflectable lock feature 66 in a deflected position taken along line B-B in FIG. 7A. While FIGS. 6A-7B describe a further embodiment, it will be appreciated that embodiments of the present disclosure encompass other lock features 66, 78 as described elsewhere herein. In addition, terms such as "pliable portion", "knurled pattern", "lock feature", "engagement feature", "lock pattern" and other terms can be used interchangeably to describe the features of the overcap and/or the ROPP closure that selectively engage each other to transfer rotational motion, torque, etc. from the overcap to the ROPP closure.

The description of the present disclosure has been presented for purposes of illustration and description, but is not intended to be exhaustive or limiting of the disclosure to the form disclosed. Many modifications and variations will be apparent to those of ordinary skill in the art. The embodiments described and shown in the figures were chosen and described in order to best explain the principles of the disclosure, the practical application, and to enable those of ordinary skill in the art to understand the disclosure.

While various embodiments of the present disclosure have been described in detail, it is apparent that modifications and alterations of those embodiments will occur to those skilled in the art. Moreover, references made herein to "the present disclosure" or aspects thereof should be understood to mean certain embodiments of the present disclosure and should not necessarily be construed as limiting all embodiments to a particular description. It is to be expressly understood that such modifications and alterations are within the scope and spirit of the present disclosure, as set forth in the following claims.

What is claimed is:

1. A closure system for a container, comprising:

said container having a longitudinal axis and a radial direction that is oriented substantially perpendicular to said longitudinal axis, wherein a neck of said container has an opening positioned on an uppermost portion of said neck;

a closure positioned on said neck of said container to seal said opening, said closure having a retainer band extending outwardly in said radial direction and at least one recess positioned on an outer perimeter of said closure;

an overcap positioned on said closure, said overcap having a lower end positioned proximate to said retainer band of said closure and extending inwardly in said radial direction to secure said overcap to said closure, wherein said overcap has a pliable portion positioned on an interior surface of said overcap;

wherein, in a first mode of operation, said pliable portion of said overcap is in a non-engaging position with said closure such that rotation of said overcap is not translated to said closure; and wherein, in a second mode of operation, said overcap is lowered relative to said closure and said container, and said pliable portion of said overcap is in an engaging position with said at least one recess of said closure to translate rotation of said overcap to said closure and separate said closure from said opening of said neck.

2. The closure system of claim 1, wherein said closure further comprises:

a top portion;

a body portion extending from said top portion to a free end;

a closure thread formed on a portion of said body portion; and said retainer band positioned between said closure thread and said free end, said retainer band comprising a first fold and a second fold.

3. The closure system of claim 1, wherein said at least one recess is part of a knurled pattern that has alternating protrusions and recesses extending about said outer perimeter of said closure.

4. The closure system of claim 1, wherein said closure is a roll-on pilfer proof (ROPP) closure that comprises:

a shell covering said opening of said neck;

a pilfer band positioned below a skirt of said neck, and a free end of said pilfer band extends inwardly in said radial direction to secure said pilfer band to said neck, wherein said pilfer band has a first interior diameter proximate to said shell and a second interior diameter at said free end, said first interior diameter being greater than said second interior diameter; and a serrated portion that selectively connects said pilfer band to said shell, wherein, in said second mode of operation, said translation of rotation of said overcap to said ROPP closure severs said serrated portion.

5. The closure system of claim 4, wherein said serrated portion is positioned between said retainer band and said pilfer band, and wherein, in said first mode of operation, said pilfer band is positioned between said neck and said lower end of said overcap.

6. The container closure system of claim 1, further comprising a pilfer band selectively connected to said closure, wherein said retainer band is positioned between said at least one recess and a free end of said pilfer band, and wherein said retainer band comprises at least one fold to extend the retainer band outward in said radial direction.

7. The closure system of claim 1, further comprising a coating on said closure to increase friction with said pliable portion of said overcap in said second mode of operation.

8. The closure system of claim 1, wherein a top portion of said overcap is deflectable from an initial shape in said non-engaging position to a substantially planar shape in said engaging position.

9. A closure system for a container, comprising:

a closure positioned on a neck of the container to seal an opening of the container, the container having a longitudinal axis and a radial direction that is oriented substantially perpendicular to the longitudinal axis, wherein the neck has a skirt and the opening is positioned on an uppermost portion of the neck;

said closure comprising:

a top portion covering the opening;

a body portion extending from said top portion, said body portion including a closure thread and a retainer band extending outwardly in the radial direction;

a pilfer band positioned below the skirt of the container neck, said pilfer band extending inwardly in the radial direction to secure said pilfer band to the container neck; and a tear band that selectively connects said pilfer band to said body portion;

an overcap positioned on said closure, said overcap having a lower end positioned between said retainer band and said pilfer band of said closure, said lower end extending inwardly in the radial direction to secure said overcap to said closure, wherein said overcap has a pliable portion positioned on an interior surface of said overcap; and wherein, in a first mode of operation, said pliable portion of said overcap is in a non-engaging position with said closure such that rotation of said overcap is not translated to said closure;

wherein, in a second mode of operation, said overcap is lowered relative to said closure and the container, and said pliable portion of said overcap is in an engaging position with said closure to translate rotation of said overcap to said closure and separate said closure from the opening of the container neck, and wherein said translation of rotation of said overcap to said closure severs said tear band.

10. The closure system of claim 9, further comprising:

at least one recess positioned on an outer perimeter of said closure, wherein said pliable portion of said overcap engages said at least one recess in said second mode of operation such that rotation of said overcap is translated to said closure, and wherein said at least one recess is part of a knurled pattern that has alternating protrusions and recesses extending about said outer perimeter of said closure.

11. The closure system of claim 9, wherein said retainer band comprises:

a first fold with a first diameter; and a second fold with a second diameter, said first diameter being greater than said second diameter.

12. The closure system of claim 11, wherein said retainer band is positioned between said closure thread and a free end of said pilfer band, and wherein said tear band is positioned between said second fold of said retainer band and said pilfer band.

13. The closure system of claim 9, further comprising a coating on said closure to increase friction with said pliable portion of said overcap in said second mode of operation.

14. The closure system of claim 9, wherein a top portion of said overcap is deflectable from an initial shape in said non-engaging position to a substantially planar shape in said engaging position.

15. A closure system for a container, comprising:

a closure positioned on the container to seal an opening of a neck of the container, the container having a longitudinal axis and a radial direction that is oriented substantially perpendicular to the longitudinal axis, wherein said closure has a retainer band extending outwardly in the radial direction;

an overcap positioned on said closure, said overcap having a lower end positioned proximate to said retainer band of said closure and extending inwardly in the radial direction to secure said overcap to said closure, wherein said overcap has a pliable portion positioned on an interior surface of said overcap, wherein, in a first mode of operation, said pliable portion of said overcap is in a non-engaging position with said closure such that rotation of said overcap is not translated to said closure, and wherein, in a second mode of operation, said overcap is lowered relative to said closure and the container, and said pliable portion of said overcap is in an engaging position with said closure to translate rotation of said overcap to said closure and separate said closure from said opening of said neck; and a coating on said closure to increase friction with said pliable portion of said overcap in said second mode of operation.

16. The closure system of claim 15, further comprising:

at least one recess positioned on an outer perimeter of said closure, wherein said pliable portion of said overcap engages said at least one recess in said second mode of operation such that rotation of said overcap is translated to said closure, and wherein said at least one recess is part of a knurled pattern that has alternating protrusions and recesses extending about said outer perimeter of said closure.

17. The closure system of claim 15, wherein said closure is a roll-on pilfer proof (ROPP) closure that comprises:

a shell covering the opening of the neck;

a pilfer band positioned below a skirt of the neck, and said pilfer band extends inwardly in the radial direction to secure said pilfer band to the neck;

a serrated portion that selectively connects said pilfer band to said shell, said serrated portion being positioned between said retainer band and said pilfer band, wherein, in said second mode of operation, said translation of rotation of said overcap to said ROPP closure severs said serrated portion.

18. The closure system of claim 15, wherein said retainer band comprises at least one fold to extend said retainer band outward in the radial direction.

19. The closure system of claim 15, wherein said closure further comprises:

a top portion;

a body portion extending from said top portion to a free end;

a closure thread formed on a portion of said body portion; and said retainer band positioned between said closure thread and said free end, said retainer band comprising:

a first fold with a first diameter; and a second fold with a second diameter that is less than the first diameter.

20. The closure system of claim 19, wherein said closure further comprises a pilfer band with a pilfer band end that has a third diameter that is less than said second diameter.

* * * * *